US011108186B2

(12) United States Patent
Sandel

(10) Patent No.: US 11,108,186 B2
(45) Date of Patent: Aug. 31, 2021

(54) INTERNAL SHUTTERS AND LOCK MECHANISMS FOR SAFETY ELECTRICAL RECEPTACLES

(71) Applicant: Vernon Ralph Sandel, Licking, MO (US)

(72) Inventor: Vernon Ralph Sandel, Licking, MO (US)

( * ) Notice: Subject to any disclaimer, the term of this patent is extended or adjusted under 35 U.S.C. 154(b) by 0 days.

(21) Appl. No.: 16/909,853

(22) Filed: Jun. 23, 2020

(65) Prior Publication Data

US 2020/0403349 A1 Dec. 24, 2020

Related U.S. Application Data

(60) Provisional application No. 62/865,257, filed on Jun. 23, 2019.

(51) Int. Cl.
*H01R 13/453* (2006.01)
*H01R 25/00* (2006.01)
(Continued)

(52) U.S. Cl.
CPC ..... *H01R 13/4534* (2013.01); *H01R 25/006* (2013.01); *H01R 43/26* (2013.01); *H01R 2103/00* (2013.01)

(58) Field of Classification Search
CPC ..... H01R 13/4534; H01R 13/453; H01R 13/4532; H01R 25/006; H01R 43/26; H01R 2103/00
(Continued)

(56) References Cited

U.S. PATENT DOCUMENTS 2,155,925 A * 4/1939 Blinn ..... H01R 13/4534 439/138
4,379,607 A * 4/1983 Bowden, Jr. ..... H01R 13/4534 439/137
4,822,290 A * 4/1989 Cauley ..... H01R 13/4534 439/137
(Continued)

*Primary Examiner* — Gary F Paumen
(74) *Attorney, Agent, or Firm* — Keith D. Grzelak; Wells St. lohn P.S.

(57) ABSTRACT

Four different combinations of a sliding internal shutter and shutter lock control mechanism are described along with methods of incorporating the combinations into receptacles to prevent foreign objects from gaining access to power. Each combination is composed of a ramped shutter, spring biased in a closed position, and two to four lock control mechanisms, each of which moves a locking bar out of contact with an impeding surface on the shutter. The entrance of a standard plug into the assembled receptacle moves all the locking bars away from the shutter's impeding surfaces and the blades interaction with the ramps moves the shutter to the open position allowing the blades to continue to power. The combinations may be installed in receptacles as standalone modules that are installed in a receptacle case or the parts may be integrated directly into a receptacle structure with the proper support structure. These four shutter-lock control mechanism combinations provide superior safety and do not suffer the rejection problem common to the present tamper resistant receptacles. Another three shutters that open by rotary action when the lock control mechanism is in the unlocked state are presented. The safeties of these are similar to the present tamper resistant receptacles but do not have the rejection problem. A method is also provided.

21 Claims, 8 Drawing Sheets

(51) Int. Cl.
*H01R 43/26* (2006.01)
*H01R 103/00* (2006.01)

(58) Field of Classification Search
USPC ..... 439/137, 139
See application file for complete search history.

(56) References Cited

U.S. PATENT DOCUMENTS 4,867,693 A * 9/1989 Gizienski ..... H01R 13/4534 439/137
4,867,694 A * 9/1989 Short ..... H01R 13/4534 439/137
5,006,075 A * 4/1991 Bowden, Jr. ..... H01R 13/4534 439/137
5,267,870 A * 12/1993 Maresh ..... H01R 13/4534 174/67
5,915,981 A * 6/1999 Mehta ..... H01R 13/4534 439/137
7,455,538 B2 * 11/2008 Germain ..... H01R 13/4534 439/137
7,588,447 B1 * 9/2009 Ni ..... H01R 13/4534 439/137
7,942,681 B2 * 5/2011 Ni ..... H01R 13/4534 439/137
8,568,152 B1 * 10/2013 Weeks ..... H01H 71/24 439/137
2004/0147148 A1 * 7/2004 Ng ..... H01R 13/4534 439/137
2007/0049077 A1 * 3/2007 Germain ..... H01R 13/4534 439/135
2009/0311892 A1 * 12/2009 Weeks ..... H01R 13/4534 439/137
2013/0280931 A1 * 10/2013 Weeks ..... H01R 13/518 439/137

* cited by examiner

INTERNAL SHUTTERS AND LOCK MECHANISMS FOR SAFETY ELECTRICAL RECEPTACLES

CROSS REFERENCE TO RELATED APPLICATIONS

This patent application claims priority to and the benefit of U.S. Provisional Patent Application Ser. No. 62/865,257 filed Jun. 23, 2019, entitled "Internal Shutters and Lock Mechanisms for Safety Electrical Receptacles", the entirety of which is incorporated by reference herein.

TECHNICAL FIELD

This disclosure pertains to electrical receptacles. More particularly, this disclosure relates to blocking of power in electrical receptacles and safety receptacles.

BACKGROUND OF THE INVENTION

Many methods of blocking access to power in electrical receptacles by items other than standard plugs have been proposed, and some have become commercial. However, to be truly practical a safety receptacle should be as easily accessed with a standard plug as the non-safety receptacle, and the safety features should be very difficult to defeat. The current tamper resistant receptacles (U.S. Pat. Nos. 4,379,607, 4,867,693, 5,006,075, 5,915,981, 7,588,447, and 7,942,681) required by the National Electrical Code for new construction and renovation have ramped shutters over the power slots wherein both shutters have to be touched at nearly the same time with the power tines of a plug to open the shutters. That might be practical if all receptacles were at eye level, but most are located much closer to the floor. Rejection becomes a frequent frustration. Also the safety features of these receptacles are easily defeated by two foreign objects or a paperclip bent in "U" shape, an item to which children often have access. The present invention presents a safety system with superior safety, having internally ramped sliding shutters which open only when plug blades are inserted and which easily passes plug blades. Rejection is not a problem. Also the ideas herein are extended to internal shutters that do not have the rejection problem but which only match the current tamper resistant receptacle's safety standard

SUMMARY OF THE INVENTION

The present invention describes four lock assemblies and ramped, sliding shutters that effectively deny access to power by anything but a standard plug. The shutters are internal to the receptacle so that there is no denial of access and no need to contact the shutter ramps at the same time. The four different lock control assemblies described offer greater safety than the presently commercial tamper resistant receptacles when lock control assemblies with two lock control mechanisms are used under each receptacle face. The lock assemblies and shutters can be installed in receptacles as either as "stand alone" lock modules which may be replaceable, or they can be incorporated into the design of the receptacles. Examples of both types of integration into receptacles are illustrated. In addition, the principles herein described have been extended to three types of shutters for safety receptacles that provide safety features equal to the present tamper resistant receptacles but do not have the rejection problem.

The lock module is intended to be installed in a receptacle body or case which has plug tine receptors, plug tine receivers, connectors for power, a mounting strap with ground connection which surrounds the bottom side of the case, and supporting structure for the lock modules.

The "stand alone" lock module has four main parts:

1. A top cap with two sized power slots and a ground opening to accommodate standard plugs.

2. A lock control assembly under one or both power slots, each lock control assembly having one or two lock control mechanisms wherein parts of each lock control mechanism intrude under a plug blade slot to control one or two locking bars, moving them from a locking position relative to the shutter to an unlocking position allowing the shutter to move to the open position.

3. A ramped sliding shutter 4 having two blade openings in the open position, but closed or out of alignment with the slots in the top cap. The shutters are spring biased in this closed position and locked in this position by the locking bars. Insertion of plug blades moves the locking bars to an unlocked position, allowing the shutter to move as the plug blades contact ramps, sliding it to the open position in which the shutter slots are aligned with the top cap slots and allowing the plug blades to pass through.

4. A base plate which has tine slots in alignment with the top cap slots and which provides support for the lock assemblies and guides for the sliding shutter. When the plug blades pass through the shutter slots, they continue through the base plate to power.

The design features of the ramped sliding shutter and lock mechanisms can also be integrated into a receptacle design without being a separate unit. In addition to the sliding shutter designs, three other shutter designs which only protect one blade slot per lock control mechanism are presented which have safety standards similar to the present tamper resistant receptacles but are not subject to the rejection problem.

BRIEF DESCRIPTION OF THE DRAWINGS

Preferred embodiments of the disclosure are described below with reference to the following accompanying drawings.

The view descriptions in figures below are relative to FIG. 1.

DETAILED DESCRIPTION OF THE PREFERRED EMBODIMENTS

This disclosure is submitted in furtherance of the constitutional purposes of the U.S. Patent Laws "to promote the progress of science and useful arts" (Article 1, Section 8).

Figure 1:
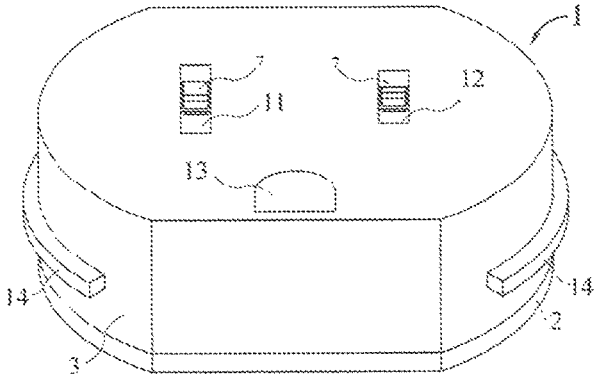
FIG. 1 shows the completed module ready to be inserted into a receptacle body with blade receivers and power connections.

FIG. 1 represents an assembled lock module 1. It has the usual longer neutral slot 11, the shorter hot slot 12, and the opening for the ground tine 13. Although the face shown does not have the usual recesses of common receptacles, they could be molded in during manufacture of the top cap 3. At the angle of the presentation of FIG. 1 part of an intruding lock control mechanism 7 can be seen. The top cap 3 sits on the bottom plate 2 and is chemically bonded to it. The plug tine openings 11 and 12 in the top cap 3 and the bottom plate 2 are aligned with each other, and are blocked internally by a ramped shutter 4. Not shown in FIG. 1 is a tab 20 on the bottom plate which fits into a recess **20*a* in the receptacle case 70 shown in FIGS. 26-28 which prevents the lock module 1 from being installed incorrectly. This tab 20 can be seen in FIGS. 2, 3, 7, 8 and 20**.

The lock module 1 is designed to be supported in a receptacle case such that the face of the module 1 is raised roughly 5 mm above the receptacle mounting bracket so as to pass through a standard face plate. The ridges 14 on the curved sides of the lock module 1 are a safety feature which prevents the lock module 1 from exiting through the face plate of the receptacle should it come loose from its moorings in the receptacle case. The upper surfaces of the ridges 14 are to be 5 mm from the top of the lock module 1, and thus needs to be situated level with the top of the receptacle mounting bracket when the module 1 is installed. The case needs to have the usual tine receivers 73 on the power buses 71 and 72 (FIG. 26-28) to receive power in addition to supporting structure and a mounting strap 79. If the lock module 1 is removable in the case 70, any malfunction of the module can be fixed by replacement of the one malfunctioning unit. The integration of the lock modules into the receptacle case 70 will be discussed after the discussion of the first three lock assemblies 5 and their incorporation into the lock modules.

Figure 5:
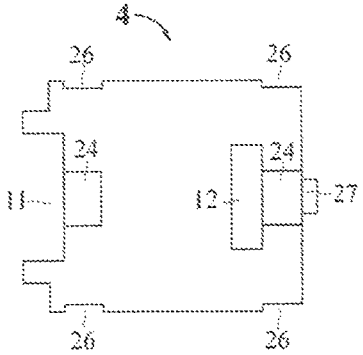
FIG. 5 is a top view of the sliding shutter.
Figure 6:
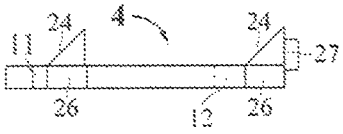
FIG. 6 is a front view of the sliding shutter.
Figure 2:
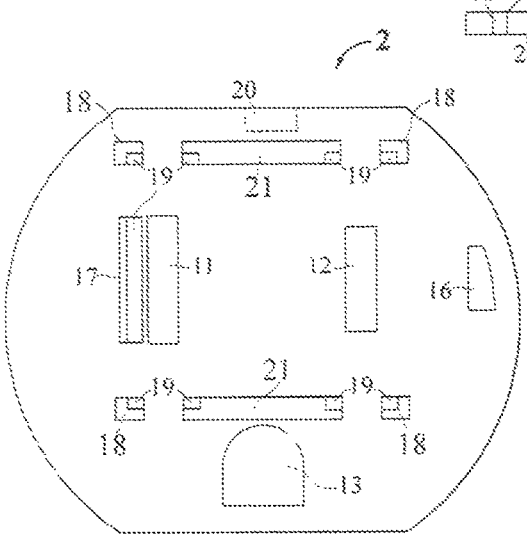
FIG. 2 shows the base plate in top view.
Figure 4:
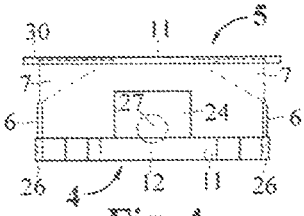
FIG. 4 shows the side view of a generic lock control mechanism in its relative position over a sliding shutter.
Figure 9:
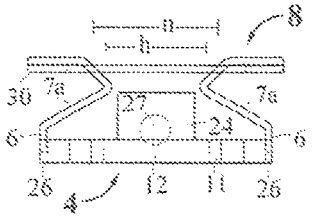
FIG. 9 is a side view of a simple lock spring control mechanism over the sliding shutter which is locked until unlocked with the insertion of a plug.

The working elements of the lock module 1 are shown in FIG. 4 which is a side view of a generic lock control assembly, or power blade geometric dimension detector 5 above the side view of the sliding shutter 4 shown in top view and front view in FIGS. 5 and 6 respectively. The relative positions of the lock control assembly and shutter are the same as in the assembled module 1. This generic lock control assembly 5 is used to represent the first three lock control assemblies 8, 9, and 10 (FIGS. 9, 10, and 16 respectively) which move sets of two lock bars 6 laterally out of cutouts 26 in a shutter 4 or **4*a* when a plug blade of the proper width enters the lock control assembly 5. The lock control assembly 5 requires either one or two lock control mechanisms 7 (two shown), each having a locking bar 6 movable between a locked position fixing the shutter 4 position, and an unlocked position allowing the shutter 4 to move. A lock module 1 may contain two to four lock control mechanisms 7 on one or two frames 30. Each mechanism 7 senses an incoming plug blade and moves a locking bar 6 to the unlocked position. The metal frame 30 which mounts one or two mechanisms 7 has a slot 11 which allows either the hot or neutral plug blades to pass through. This allows the same unit to be used for both the hot 12 and neutral 11 slots since the top cap immediately above the locking assembly 5 in the module 1 has the proper width slots. The lock control assembly installs on the frame support structures 18 and 21 with the corners of frame 30 sitting inside recesses 19 (see FIG. 3**) in assembly.

The sliding shutter 4 which is used with the first two lock control mechanisms 8 and 9 (FIGS. 9 and 12) is depicted in top view and front view in FIGS. 5 and 6 respectively. It has an open sided neutral slot 11 and a ramp 24 for the neutral tine, a hot slot 12 and a ramp 24 for the hot blade of a plug. Only one ramp is required, but for balancing the insertion force on the hot and neutral side of the plug two are recommended. The sliding shutter 4 has four cutouts 26 for the locking bars 6 of hot and neutral lock assemblies 5 (FIG. 5), any one of which will prevent the shutter 4 from sliding to the open position when foreign objects are pushed against the ramps as discussed below. A spring retainer pin 27 holds the spring 45 (FIG. 17) which biases the shutter 4 to the closed position.

Figure 7:
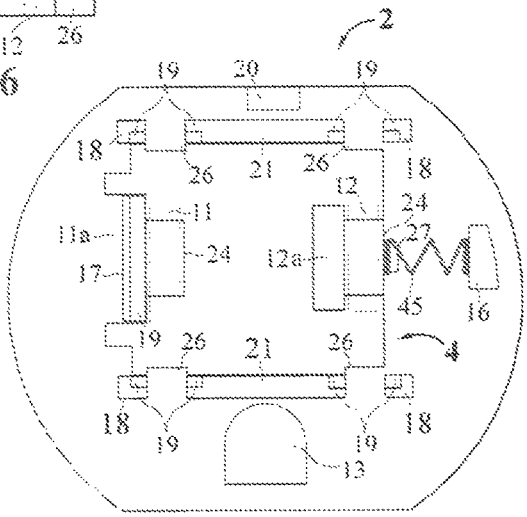
FIG. 7 shows the sliding shutter in closed position installed on the base plate in top view.
Figure 3:
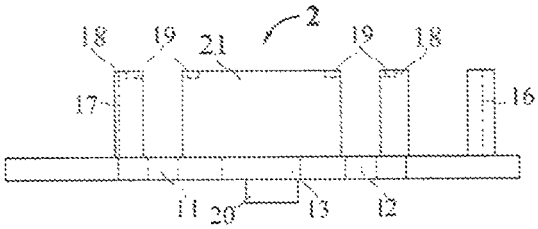
FIG. 3 presents the base plate in front view.
Figure 8:
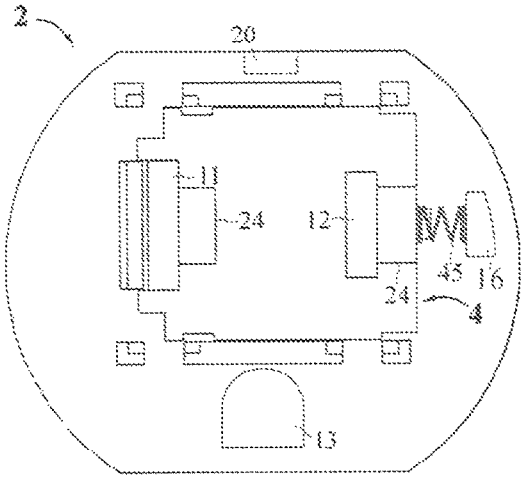
FIG. 8 is a top view of the sliding shutter in open position as ramped by plug power blades when a plug is inserted.
Figure 26:
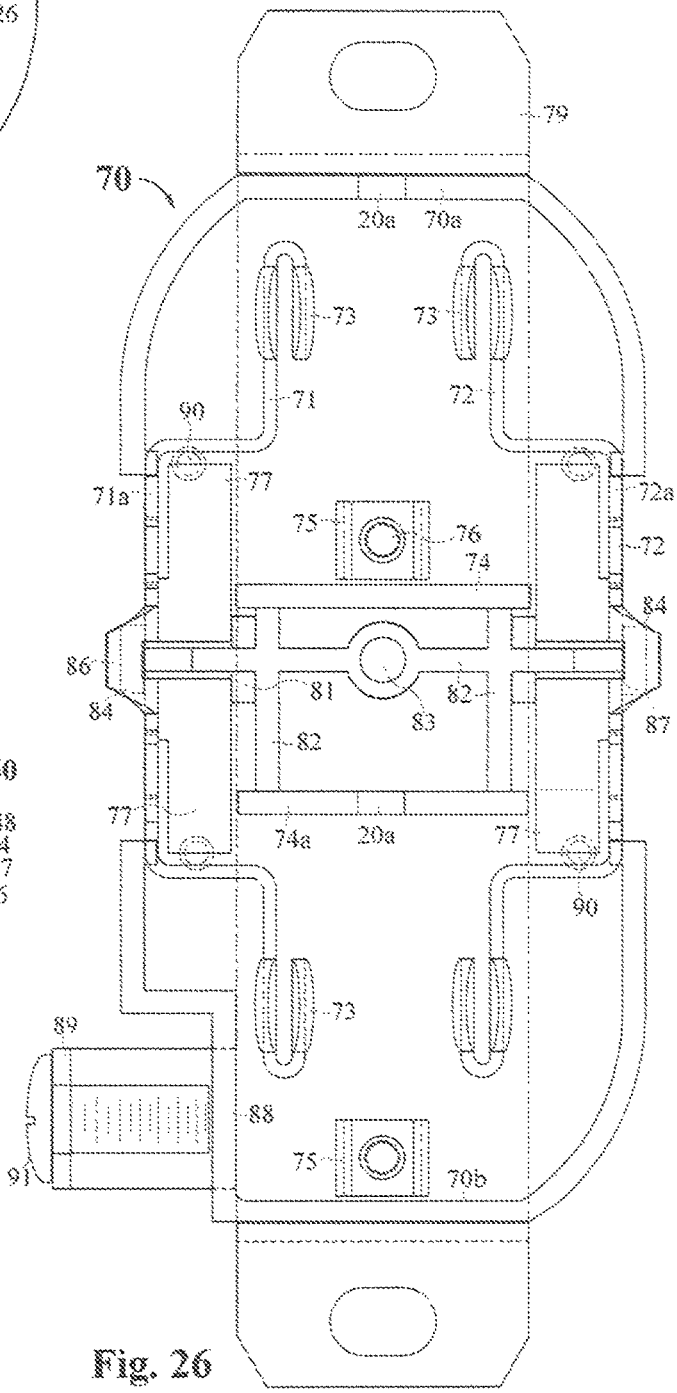
FIG. 26 illustrates a receptacle case which contains all the necessities to house two control modules in a working electrical receptacle.
Figure 27:
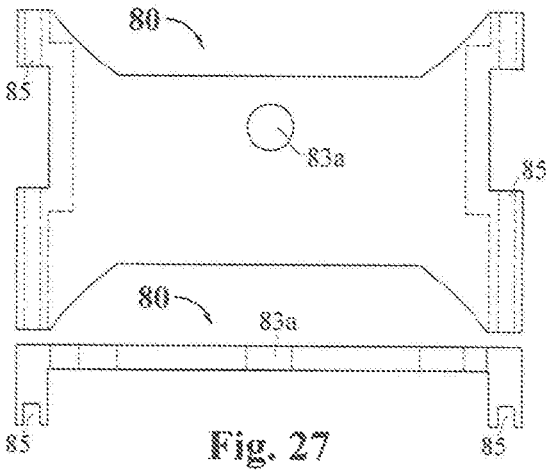
FIG. 27 shows a central top that covers the area between the two modules in an assembled receptacle.
Figure 28:
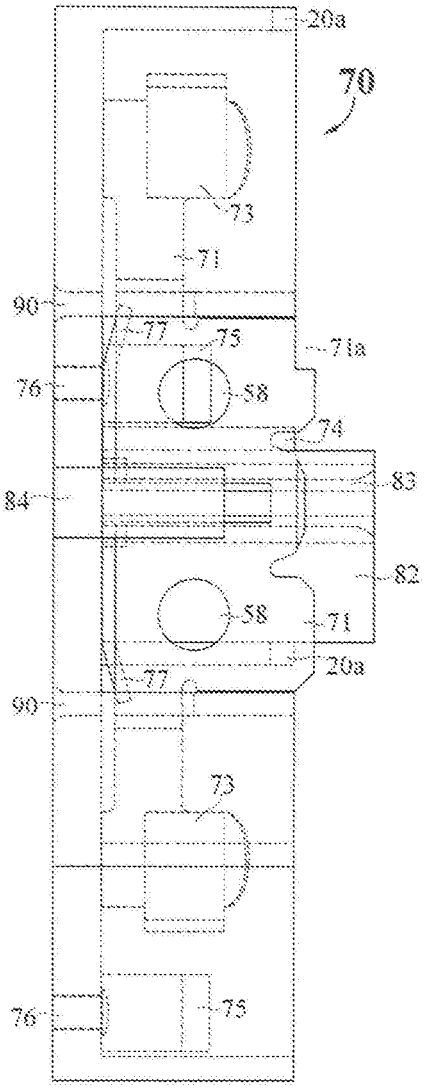
FIG. 28 is a side view of the receptacle case of FIG. 26.
Figure 29:
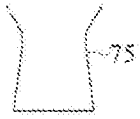
FIG. 29 is a front view showing the form of the ground tine contact.

Both the lock control assembly 5 and the shutter 4 install on the baseplate 2. FIG. 7 shows the shutter 4 installed on the base plate 3 and spring 45 biased in the closed position. The blade slots 11 and 12 in the baseplate 3 are out of alignment with those of the shutter 11*a* and 12*a*. The insertion of plug blades into the lock module 1 causes both the hot and neutral lock control mechanisms 7 to move lock bars 6 out of the shutter cutouts 26. When all the lock bars have been moved out of the shutter slots 26 the plug blades encounter the ramps 24, sliding the shutter to the open position as shown in FIG. 8. When the shutter 4 is in the open position the blades pass through the bottom plate 2 to blade receivers 73 (FIGS. 26-28). Although the locking bars are shown in cutouts 26 to restrict movement of the shutter, it should be noted that any interaction between locking bars 6 and shutter 4 which prevents movement of the shutter could be used. There are a variety of control mechanisms 5 which could move locking bars to an unlocked position, four will be discussed. The four examples are not meant to be exclusive; all control 64 mechanisms 5 which are able to accomplish the required actions of preventing shutter 4 movement until plug blades of the proper size are inserted, and then allowing shutter 4 movement thereafter are claimed.

The simplest lock control mechanism 7 that accomplishes the required freeing of the shutter 4 to move with the insertion of a plug consists of a single lock spring 7*a* spot welded to the frame 30. This spring 7*a* intrudes into the blade slot (11 or 12), and the free end 6 of which lies in a cutout 26 in the shutter 4. The lock control assembly 8 is composed of two identical lock control mechanisms 7*a* mounted on frame 30. The module 1 can have two lock control assemblies 8, one for each power slot 11 and 12, but may have only one as discussed below. The locking springs 7*a* intrude into the plug blades pathway and the lower extremity becomes the locking bar 6. The insertion of a plug bends the lock springs 7*a*, removing the ends 6 from the shutter cutouts and freeing the shutter 4 to slide to the open position as the blades slide down the ramps as shown in FIG. 8.

The possible problem with this design is that the neutral slot 11 has to accommodate both the narrower blade of three prong plugs and the wider hot blade of polarized plugs. Thus when a wider blade enters the neutral slot 11 it will bend the lock spring to a greater degree. The question then becomes will the elastic limit of the spring 7*a* be exceeded. By using a slot in the frame 30 that is somewhat wider than the wide hot blade so that the plug blade contacts the lock spring 7*a* away from its support area, the spring has more length to spread the bend. The widths of the hot and neutral blades of a polarized plug are shown as "h" and "n" respectively. A double dimensioned mock up with spring wire indicated the bend did not exceed the elastic limit at least on a short term basis.

The thickness of the spring 7*a* is a compromise between safety and reasonable plug insertion force. The spring 7*a* has to be thin enough to allow insertion of the polarized plug with reasonable force but thick enough to prevent movement of the shutter 4 when a foreign object is forcefully inserted. Instead of using two lock assemblies 5, using only one with two springs on the hot side would allow thicker springs 7*a* since the bend of the spring is less in this unit. The safety standard for this option would be the same as the current tamper resistant receptacles and rejection would not occur. The use of a single lock control assembly 5 under the hot slot could be used for the next designs as well if the additional safety of two lock control assemblies is deemed unneeded.

Figure 10:
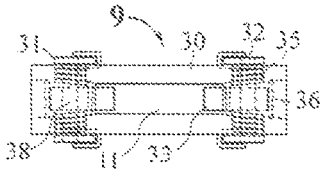
FIG. 10 is a top view of the second lock control mechanism which can lock and unlock a shutter with the insertion of a plug.
Figure 11:
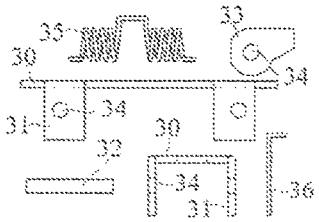
FIG. 11 shows parts which make up the mechanism of FIG. 10.
Figure 12:
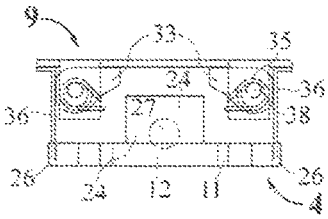
FIG. 12 is a side view of the second lock control mechanism over a sliding shutter which is locked and unlocked with the insertion of a plug.
Figure 13:
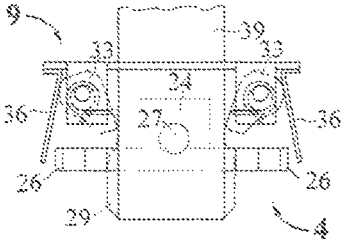
FIG. 13 is a side view of the second lock control mechanism over a sliding shutter with a plug blade passing through the open shutter.

The second lock control assembly 9 is shown in top view in FIG. 10 and further illustrated in FIGS. 11-13. FIGS. 12 and 13 show the side view of the lock control assembly 9 over the shutter 4 in the relative positions they occupy in the module 1. The parts used to build lock control assembly 9 are shown in FIG. 11. The frame of the lock control assembly 9 has a slot 11 sized for the wide plug blade, and the same lock control assembly 9 is used for the hot slot 12. The lock control mechanism of this lock control assembly 9 has a torsion spring 35 biased, pivoted intruder 33 with a flat spot which lies against the locking bar 36 spot welded to frame 30. Entry of a plug blade into the lock control assembly 9 rotates the intruder 33 on its shaft 32 which is fixed in opening 34 of downward extensions 31 on the frame 30. This rotation of the intruder 33 bends a locking bar 36 out of a cutout 26 on the shutter 4 as illustrated in FIG. 13, and the torsion spring 35 rotates the intruder 33 back to the upward position when the plug blade is removed. The shutter 4 used with the lock control assembly 9 is the same one employed with the lock control assembly 8 shown in FIGS. 4-8. When a plug is introduced into lock module 1 containing the lock control assembly 9, the sequence of events is identical to the previous discussion except for the different process for moving the locking bars out of the cutouts in the shutter 4, so the discussion will not be repeated. However there is one major difference from the previous example. With the present lock control assembly 9 the width of the neutral plug blade makes no difference as both the wide blade and the narrower one bend the lock spring 36 the same minimal amount even though the intruder 33 is rotated to a greater degree by the wide blade. Thus a heftier locking spring 36 may be used.

Figure 14:
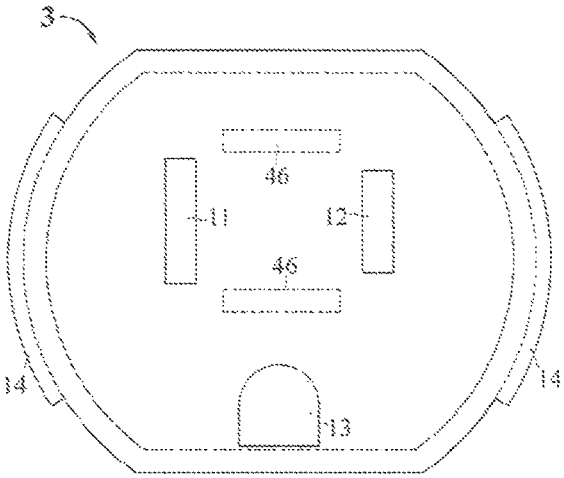
FIG. 14 shows the top view of the top cap for the modules containing the lock control mechanisms of FIGS. 9, 12, 21.
Figure 15:
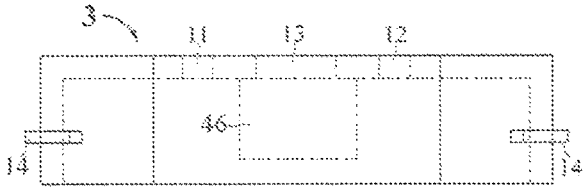
FIG. 15 is the front view of the top cap used with the lock control mechanisms of FIGS. 9 and 12.

FIGS. 14 and 15 show the top and front view of the top cap 3 used with the last two examples of completed lock modules 1, and is also used with the next example as well. The top cap 3 has the hot and neutral slots 12 and 11 respectively and two walls 46 which keep the shutter 4 flat against the bottom cap 2, but loosely enough to allow the shutter to slide freely. The ridges 14 on the curved sides are positioned 5 mm down from the face and lie against the receptacle cover when it is installed. This keeps the lock module 1 from coming through the holes in the cover if the module 1 should come loose from its moorings.

Figure 16:
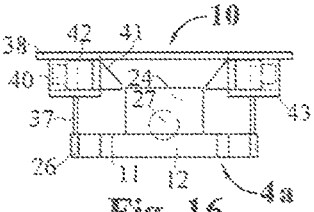
FIG. 16 is the side view of the third lock control mechanism over a sliding shutter which is locked and unlocked with the insertion of a plug.
Figure 17:
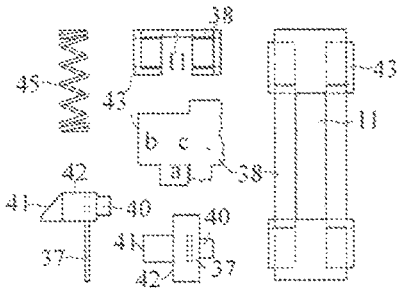
FIG. 17 shows the parts that make up the lock control mechanism of FIG. 16.
Figure 18:
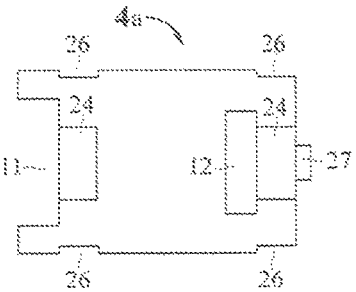
FIG. 18 is the top view of the shutter in FIG. 16.

The third example of a lock control assembly 10 is shown in side view over the shutter 4*a* used with it in FIG. 16. The shutter is shown in top view in FIG. 18. The parts used to assemble the lock control assembly 10 are shown in FIG. 17. The frame 38 is formed from a flat sheet of metal with a wide slot 11 and four appendages 43. The portions labeled a, b, and c of each appendage 43 are bent upward at the lines to form rectangular cavities 43 on each end of the frame 38. The plungers 42 fit loosely enough in the cavities 43 to readily slide back and forth in them. The plungers 42 have ramps 41 which extend out of the cavities 43 and underneath the blade slot in the frame 38. The opposite end of the plunger 42 has a pin 40 which holds a spring 45 biasing the plunger 42 against the "a" stop portion of the cavity 43, the counter support for the spring being the side of the top cap 3. The plunger has a lock bar 37 molded into it which lies in a cutout 26 in the shutter 4*a* when assembled into a module 1. The shutter whose top view is shown in FIG. 18 is narrower than the shutter 4 used with the previous lock control assemblies 9 and 10, but the overall form and purpose are the same.

Figure 19:
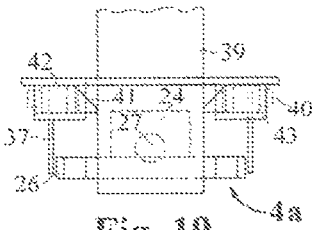
FIG. 19 is the side view of the lock control mechanism of FIG. 16 with a plug blade passing through the open shutter.
Figure 20:
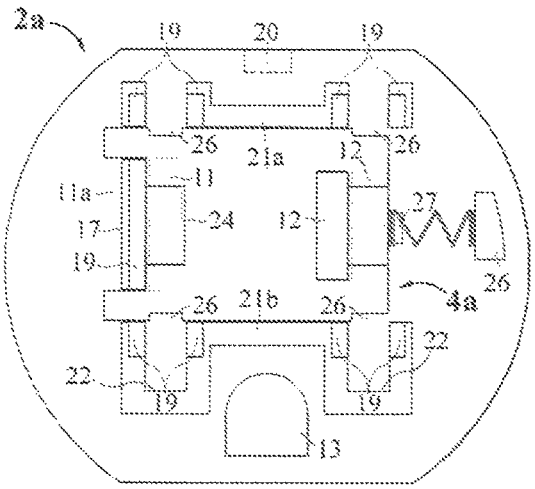
FIG. 20 shows the top view of the shutter of FIG. 18 installed on the base plate appropriate for the lock control mechanism of FIG. 17.

As with the last two lock module 1 examples, two lock control assemblies 10 and the shutter 4*a* install on the bottom plate 2*a* of FIG. 20 with its differently shaped shutter guiding walls 21*a* and 21*b*, shutter stop 17, and are covered with the chemically bonded top cap 3 of FIGS. 14 and 15. When a plug is inserted into this lock module 1 the blades first meet the plunger ramps 41 causing the plungers 42 to retreat into the cavity 43 against the spring 45 bias and moving the lock bars 37 out of the cutouts 26 on the shutter 4*a*. When all the lock bars are withdrawn from their shutter cutouts 26, the blades encounter the shutter ramps 24, sliding the shutter 4*a* to the open position as analogously shown in FIG. 8, and allowing the blades to pass through to power. FIG. 19 shows a plug blade passing through the lock control assembly 10 and shutter 4*a* on its way to power. The advantage of this version of the lock module 1 is that the lock bars do not have to bend, and therefore they can be much stronger, resulting in a safer receptacle.

An example of the integration of two modules into a receptacle is shown in FIGS. 26-30. The first three examples of lock control assemblies 8, 9, and 10 were drawn with dimensions resulting in modules 1 which have the same height so that they all would fit in the same receptacle case 70 shown in top view in FIG. 26, side view in FIG. 28, and a composite view in FIG. 30. The receptacle case 70 has a mounting strap 79 which surrounds the bottom of the case 70, is attached to the case 70 through the ground tine contacts 75 with rivets 76, and has an appendage 89 for ground wire attachment. The case 70 is indented at 88 to accommodate the ground terminal screw 91. The shape of the ground tine receiver 75 is shown in front view in FIG. 29. The power buses 71 and 72 have cutouts at 71*a* and 72*a* (FIG. 26) to accommodate the top module 1 and the usual connective strip 86 which can be cut to allow the two sockets to be wired independently. The four holes 90 in the case floor are for "push wire" wiring where the wires are held against the buses by spring sections 77 of the power busses 71 and 72. The power buses 71 and 72 are secured between the two outer stops 84 and the four inner blocks 81, and the top is stabilized by slots 85 in the middle top 80. The upper wall of the case 70 and the module support wall 74*a* have recesses 20*a* for the module orienting pegs 20. The central walls 82 and the cover plate screw opening 83 top are supports and bonding surfaces for the middle top 80 when installed with chemical bonding.

FIG. 27 shows the middle cap 80 in top and front view. The slots 85 stabilize the tops of the power buses 71 and 72, and the opening 83*a* is for the screw that mounts the receptacle cover plate (not shown).

Figure 30:
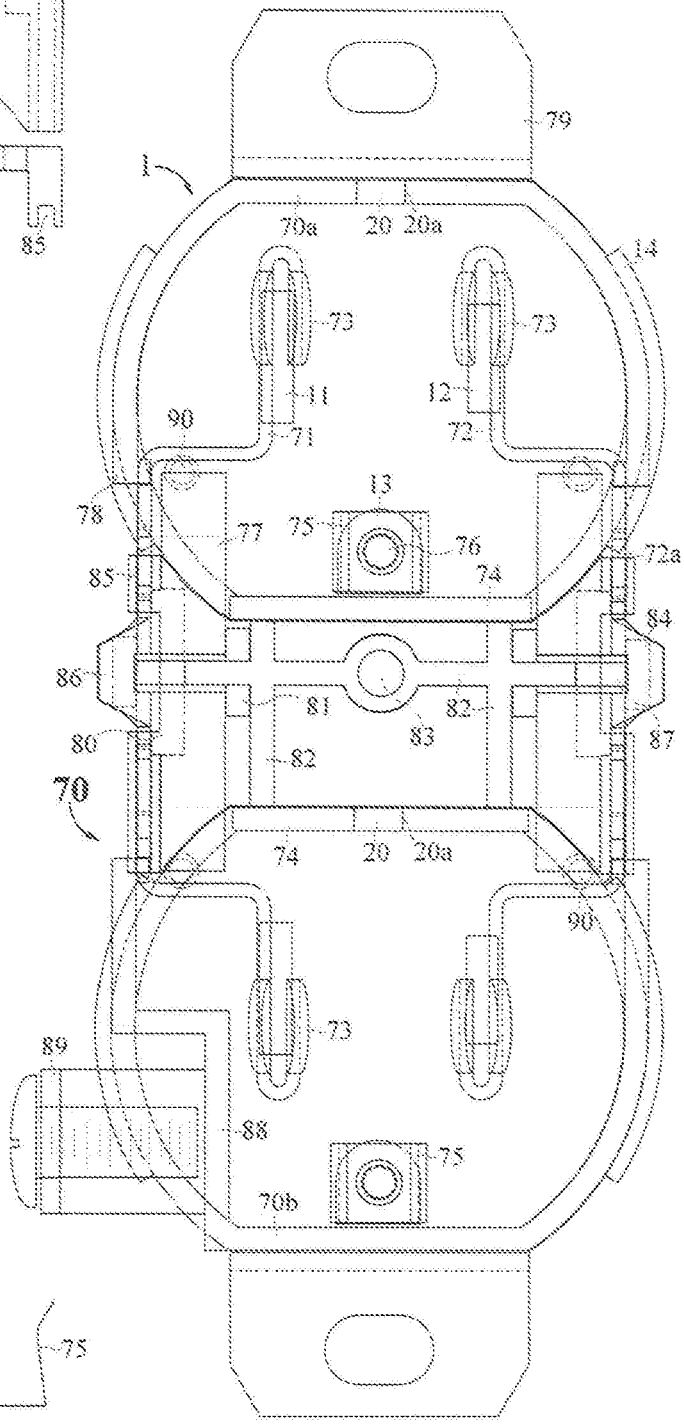
FIG. 30 shows a completely assembled receptacle using two "transparent" modules to show the relationship of all the parts.
Figure 31:
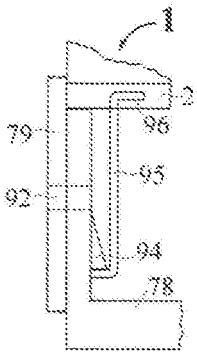
FIG. 31 illustrates a simple "snap in" retaining system that would make the modules of a receptacle removable.

FIG. 30 is a composite drawing showing the completed receptacle in top view. In order to show integrated structure the modules 1 and center top 80 are made transparent for clarity rather than using dotted lines for the covered parts. The modules 1 can be chemically bonded to the case. Alternatively, each module 1 could be attached with four spring clips 95 as shown in FIG. 31 which engage with four ramped stops 94 on the top and bottom case walls 70*b* of the receptacle case 70*a* (FIGS. 26 and 30) and also on the central support walls 74 and 74*a* so that the modules 1 are retained when pushed into place. Access holes through the mounting strap 79 and receptacle case 70 allow access to the four spring clips nearest the mounting strap 79 to be released with pins, making the modules 1 replaceable. The spring clips 95 can be molded into the bottom plate 2 of the modules 1.

Figure 22:
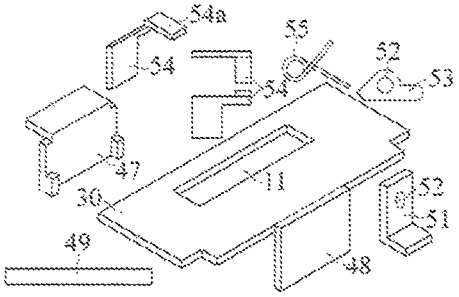
FIG. 22 illustrates the parts that make up the fourth example of a lock control mechanism.
Figure 23:
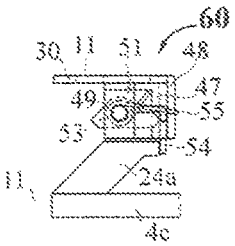
FIG. 23 is a front view of the neutral lock control mechanism of FIG. 21 over the portion of the shutter that interacts with it.
Figure 24:
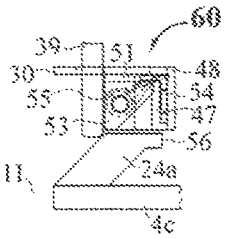
FIG. 24 illustrates the unlocking of the shutter when a plug blade is inserted into the lock control mechanism of FIG. 23.
Figure 25:
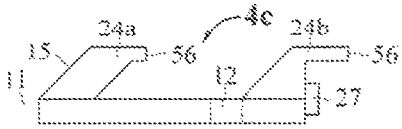
FIG. 25 is a front view of the shutter used with the lock control mechanism illustrated in FIGS. 21-24.
Figure 21:
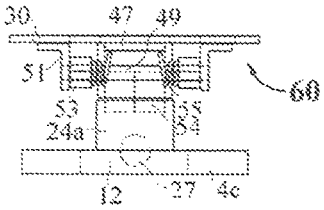
FIG. 21 is a side view of the fourth example of a lock control mechanism over the side view of the shutter used with it.

The next example of a lock control assembly 60 is shown in side view in its relative position over its shutter 4*c* in FIG. 21. The parts used to construct this lock control assembly 60 are illustrated in FIG. 22. The locking bar 54 shown in top, front and isometric view in FIG. 22 is of particular interest since the lock control assembly drawings 60 do not show the locking bars 54 well. The flat horizontal portion 54*a* sits on the rounded end of the intruder 53, so when the intruder is rotated by a plug blade the lock bar is lifted as shown in FIG. 24. The shutter 4*c* is shown in front view in FIG. 25. This lock control assembly uses the back side 56 of the ramps 24*a* and 24*b* as the impeding surface for the locking bars 54. Each lock control assembly 60 has two lock bars 54 extending behind the shutter ramps 24*a* and 24*b* at 56 preventing the shutter 4*c* from sliding to the open position when foreign objects are pressed against the ramps 24*a* and 24*b*. The lock bars 54 are housed between the frame's downward extension 48 and the backer 47 which is spot welded to the frame 30. Torsion springs 55 bias the lock bars 54 and intruder 53 rounded ends downward. The intruders 53 mount on shaft 49 through openings 52 sized for easy rotation, and are held in place by the torsion springs 55. As shown in FIG. 23, a portion of the lock bars 54 extend over to lie on the rounded ends of the intruders 53. As illustrated in FIG. 24, when a plug blade of the proper width is inserted into the neutral slot 11 of the lock control assembly 60, rotation of the intruders 53 lift both lock bars 54 above the stop surface 56 (FIG. 24) of the shutter 4*c* ramp 24*a*. When the lock bars 54 of both the hot and neutral lock control assemblies 60 have been lifted, the shutter 4*c* is free to move to the open position as the plug blades slide down the ramps on their way to power as stated and illustrated previously with the first three lock control assemblies 8, 9, and 10.

As with the previous examples, the lock control assemblies can be used in either a lock module 1 or integrated into a receptacle structure. When used in a lock module 1, it is clear from the previous examples that proper guides and a stop for the shutter 4*c* are required. Also the height of the lock control assembly 60 is greater than that of the previous examples so the height of an assembled module 1 would be greater, requiring a different receptacle case and top cap. Rather than present the design requirements to fit lock control assembly 60 and its shutter 4*c* into a module 1, it will be used to demonstrate how the lock control assemblies 7 with their shutters can be integrated into a receptacle structure. The process would be similar for all the lock control assemblies 7 and shutters, but design changes would be necessary for each.

Figure 35:
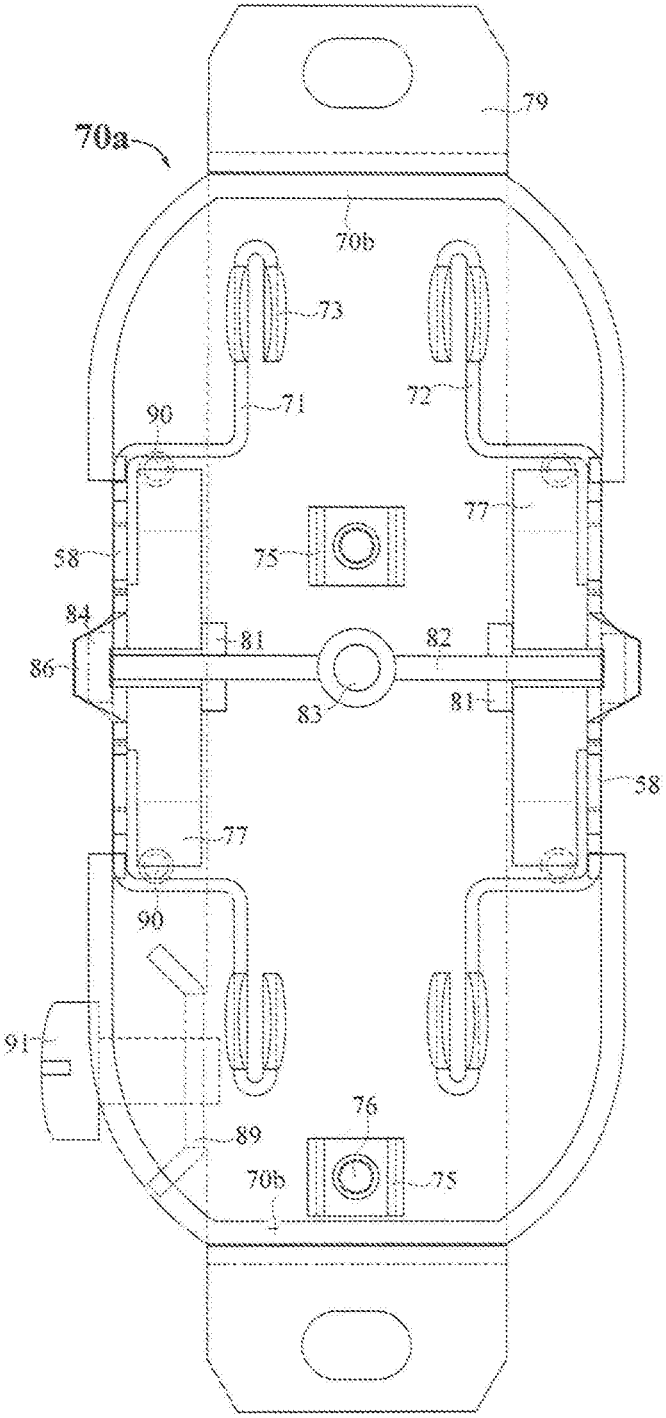
FIG. 35 is the top view of an appropriate receptacle case for the integration of the fourth lock control mechanisms and shutters into receptacle structure.
Figure 36:
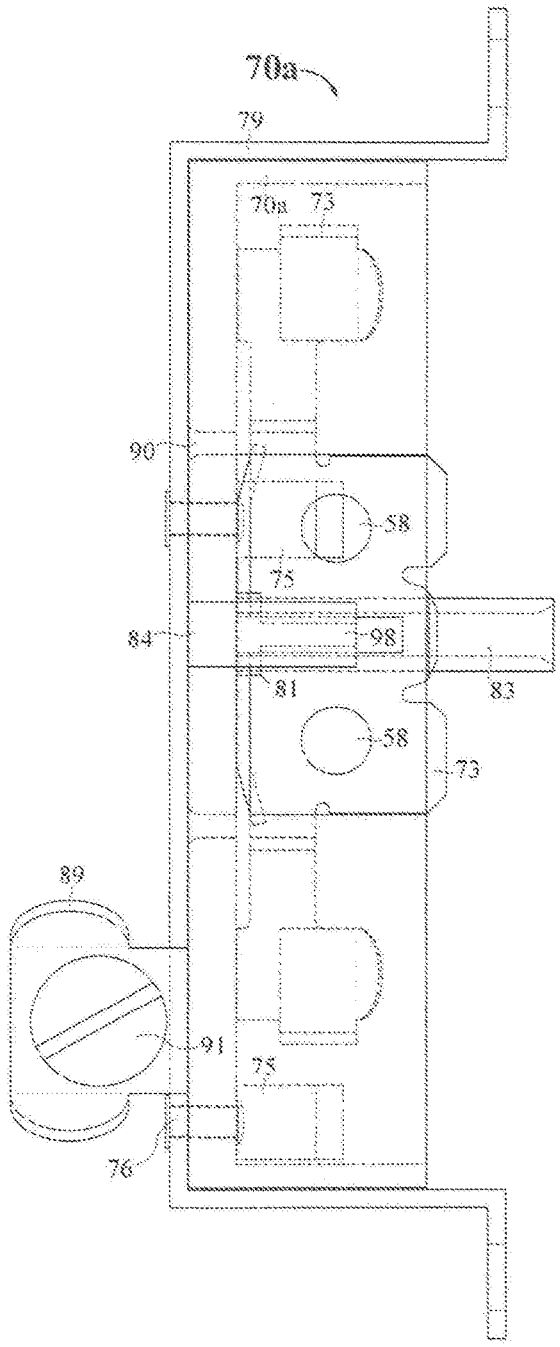
FIG. 36 is the side view of the receptacle case of FIG. 35.

An example of a receptacle case 70*a* that is appropriate for integrating lock control assembly 60 and its shutter 4*c* into a receptacle is shown in FIG. 35 in top view and in side view in FIG. 36. It requires a mounting strap 79 which surrounds the bottom of the case 70*a*, and has a ground terminal 89 that bends downward from the mounting strap 79. The ground contacts are riveted through the case bottom to the mounting strap 79 with rivets 76. The case has power buses 71 and 72 with the usual threaded openings 58 for wire attachment screws (not shown). The power buses 71 and 72 are held horizontally between bus stops 84 and inner stops 81. The top cap 93 (FIGS. 38 and 39) has slots 85 which stabilize the tops of the power buses 71 and 72 both horizontally and vertically. A tube 83 provides the opening for the cover plate screw (not shown). A stabilizing wall 82 connects the bus stops 84, the central tube 83, and the inner stops 81. The openings 90 in the case bottom are for "push wire" power connection and the wire is held firmly by bus springs 77.

Figure 32:
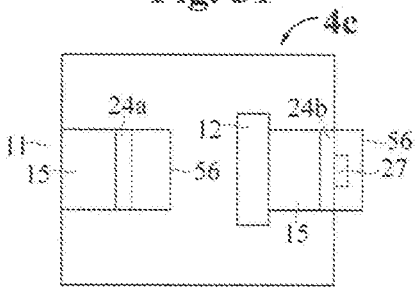
FIG. 32 is the top view of the shutter used with lock control mechanism of FIG. 21.
Figure 33:
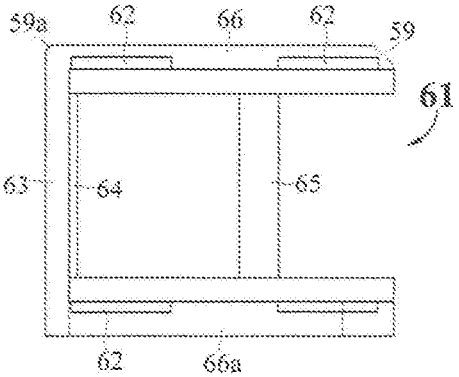
FIG. 33 is the top view of a support structure to hold the fourth lock control assemblies and shutters when integrated into the receptacle structure.
Figure 34:
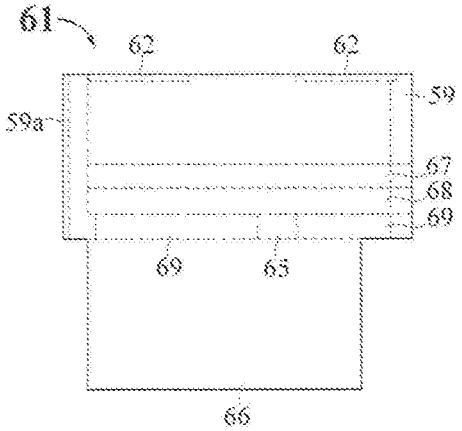
FIG. 34 is the front view of the support structure of FIG. 33.

FIG. 33 and FIG. 34 show the top and side view respectively of a support structure 61 that fits in the case 70*a*. This structure has slots 68 between ridges 67 and 69 which provide support and guide the shutter 4*c* which is shown in top view in FIG. 32 and in front view in FIG. 25. The support structure 61 is beveled at 59 and 59*a* to fit in the upper half of case 70*a*. The support structure 61 also has detents at 62 to hold the lock control mechanisms 60 securely in place between the support structure 61 and the top cap 93 (FIGS. 38 and 39) when installed. The cross beam 65 blocks the closed shutter's hot slot 12 and provides stability. The lip 64 under the closed shutter 4*c* prevents foreign objects from squeezing between the stop wall 63 and the closed shutter 4*c*. The same support structure 61 is used for both the upper and lower sockets.

Figure 37:
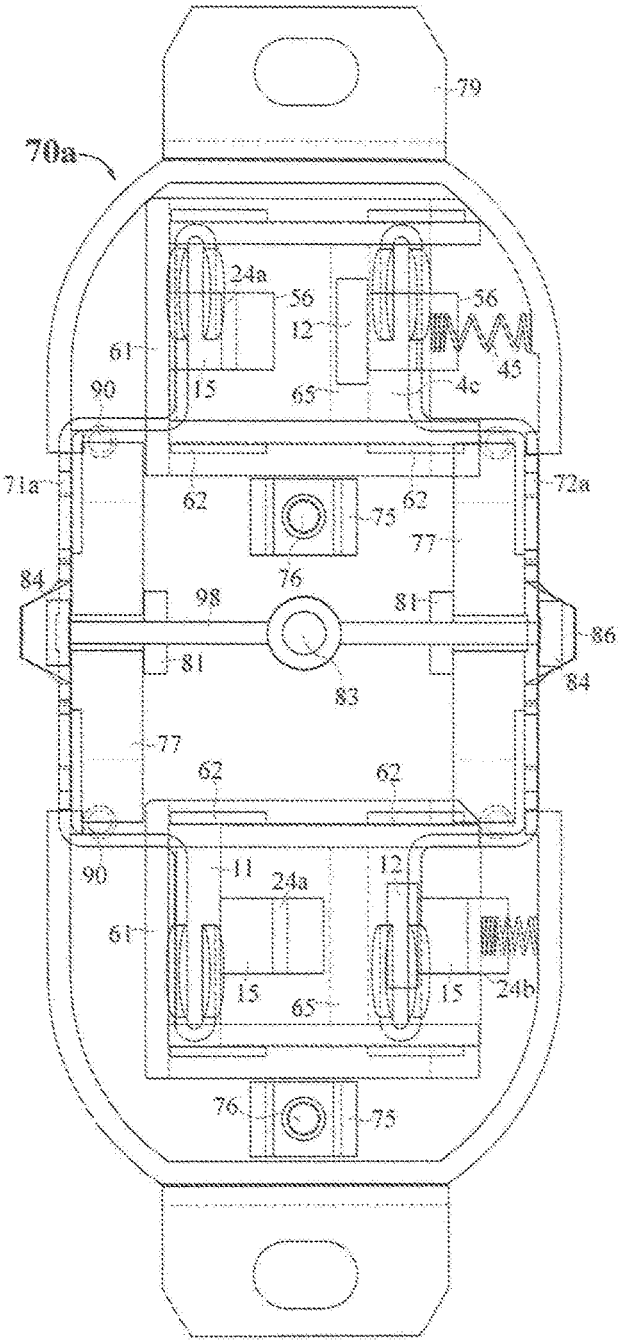
FIG. 37 shows the receptacle case of FIG. 35 with the support structures and shutters installed.

The case 70*a* is assembled by placing the shutters into the support structures 61 (slot 68 in FIG. 34) and the combination is chemically bonded to the case floor, positioned so that the slots 11 and 12 in the lock control mechanisms 60 when installed are directly over the tine receivers 73 of the power buses 71 and 72, and springs 45 are added to the ramp spring retainers 27. FIG. 37 is a composite of the case 70*a* and support structures 61 containing the shutters 4*c* with their springs 45. The shutter 4*c* in the upper structure 61 is spring 45 biased to the closed position where both the blade slots 11 and 12 are blocked. In the lower structure 61 the shutter 4*c* is shown in the open position as if plug blades have slid down the shutter's ramps 15, opening the shutter before continuing through to power. The slots 11 and 12 are unimpeded.

Figure 38:
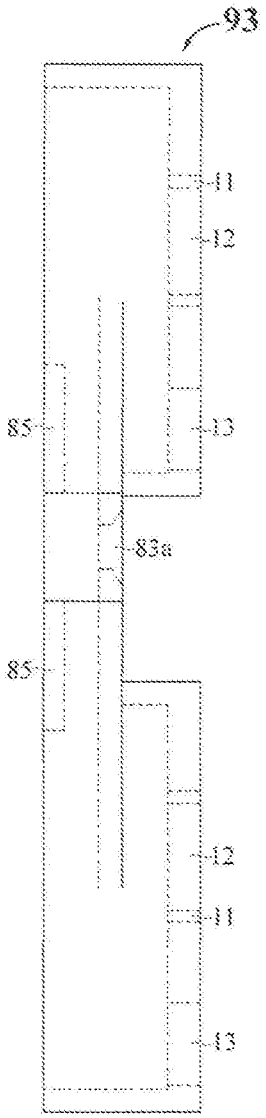
FIG. 38 is the side view of the top cap for the receptacle case of FIG. 35.
Figure 39:
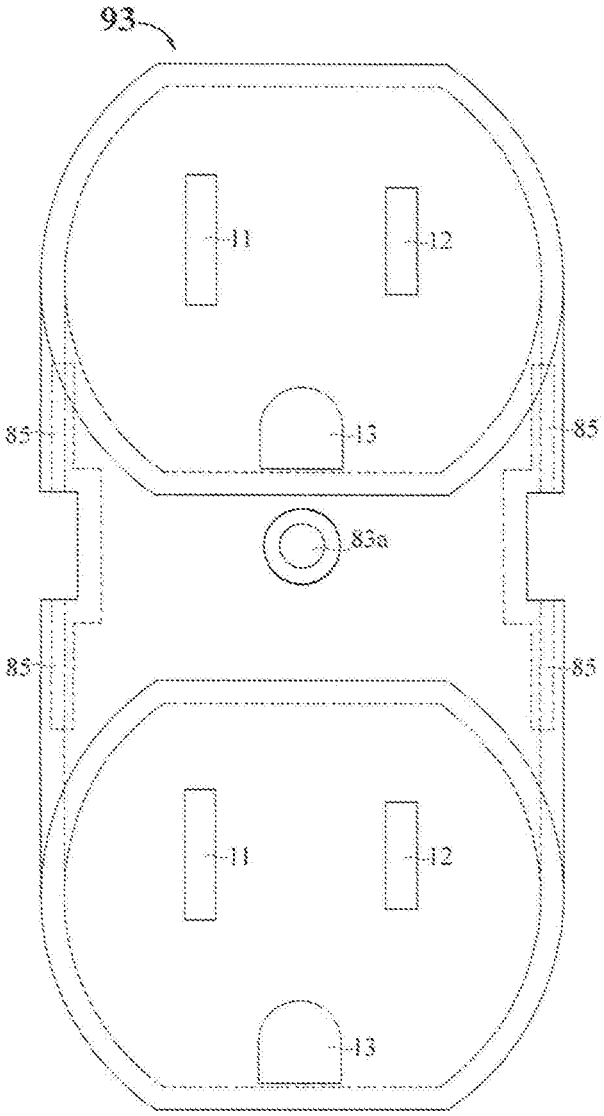
FIG. 39 is the top view of the top cap for the receptacle case of FIG. 35.

To finish the assembly of the receptacle, two lock control assemblies 60 are placed in detents 62 of the support structures 61, and the top cap 93 shown in side and top view in FIGS. 38 and 39 respectively is chemically bonded to the case.

In the previous examples the shutters were ramped sliding shutters, but other types of shutters which open differently can be used with the lock control mechanisms previously presented. Three will be discussed, but the detailed structural integration of them into a module or receptacle case is not provided since the principles already discussed would allow anyone familiar with the art to design appropriate support structures. They will be illustrated using the third lock control assemblies 10 (FIG. 16) slightly modified. Although lock control assembly 10 is probably the most appropriate, the lock control assemblies 8 and 9 could be used with the three new shutter designs as well. All three of the new shutter designs mount on the frames of the lock control assemblies 100-102.

Figure 40:
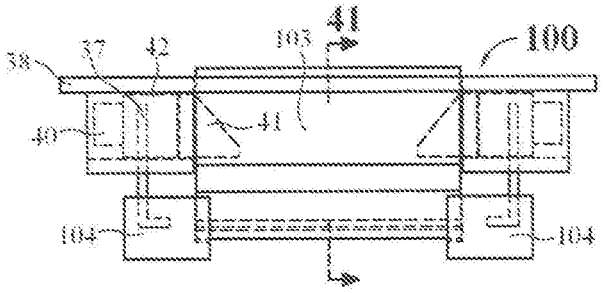
FIG. 40 is the side view of the first example of a shutter mounted on the lock control assembly.
Figure 41:
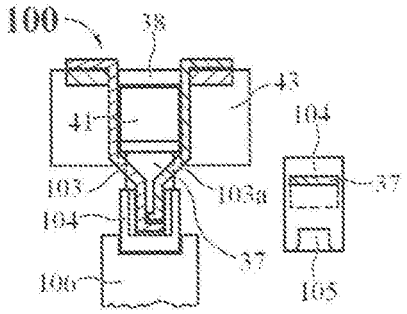
FIG. 41 is the front sectional view of the lock control assembly of FIG. 40.

The first new shutter 103 in the lock control assembly 100 is shown in side view and in front section view in FIGS. 40 and 41 respectively. The shutter is spot welded to the frame 38 of lock control assembly 100 which has a lock bar 37 with a shoe 104. The shape of the shutter is best seen in the front section view in FIG. 41. In the closed shutter state the recesses 105 in the shoes 104 of the lock control assembly 100 keep the shutter in the lock control mechanism 100 from opening when foreign objects are inserted. The insertion of a plug blade of proper width moves the lock shoes 104 away from the shutter 103 allowing the blade as it meets the angled area of the shutter to open it. The shoes 104 are guided and supported by walls 106 attached to the support walls.

Figure 42:
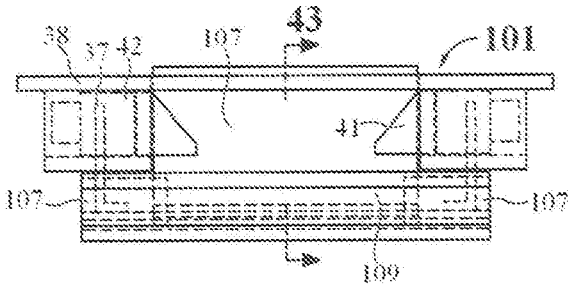
FIG. 42 is the side view of the second shutter mounted on the lock control assembly.
Figure 43:
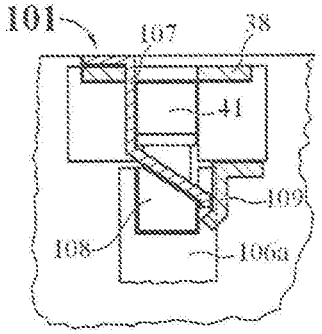
FIG. 43 is the front sectional view of the lock control assembly of FIG. 42.
Figure 44:
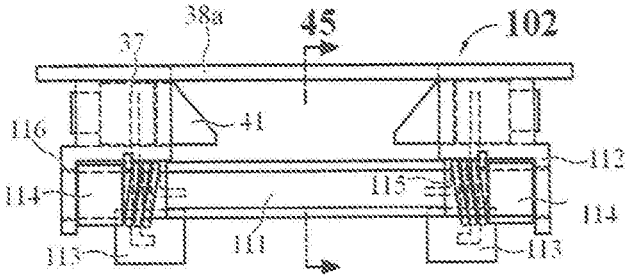
FIG. 44 is the side view of the third shutter mounted on the lock control assembly.
Figure 45:
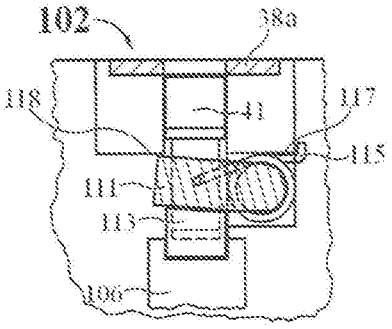
FIG. 45 is the front sectional view of the lock control assembly of FIG. 44.
Figure 46:
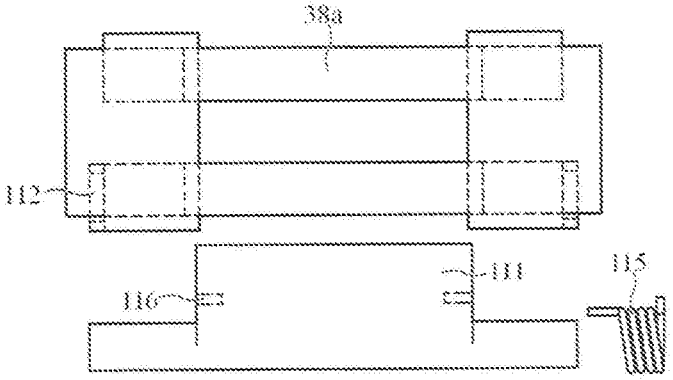
FIG. 46 shows the unique parts used to assemble the lock control assembly and shutter of FIG. 44.

The second new shutter 106 is shown in lock control assembly 101 in side view and in front section view in FIGS. 42 and 43 respectively. In the closed state the spring shutter 107 stops against spring stop 109 and is prevented from bending to the open position by lock bar shoes 108 positioned under each end of the shutter 107 and supported and guided by walls 106*a* attached to the support walls. Insertion of a plug blade into the lock control assembly 101 removes both lock bar shoes 108 from underneath the shutter 107 allowing the blade to slide down the shutter's angle, thus opening the shutter.

The third new shutter 111 used in lock control assembly 102 is shown in FIGS. 44-47. The lock control assembly used with this shutter is a modified version of that used in the 100 and 101. It has downward extensions 112 on each end of the frame 38*a* with openings to mount the shutter 111. The shutter 111 is spring biased upwardly by torsion springs 115 with spring ends in shutter openings 116 and counter stopped by the 102 frame at 117, the shutter 111 also being stopped by the 102 frame at 118. In the closed position the shutter is prevented from opening by lock bar shoes 106 under both ends of the shutter 111. The shutter 111 with springs 115 installed is inserted into the frame openings 116 and two "C" shaped malleable spacers are closed over the round ends adjacent to the frame openings 116 to fix it in place. Insertion of a plug blade causes the shoes 113 of the lock bars 37 to recede from under the shutter 111 allowing the blade to slide down the angled surface (ramp) presented as the shutter rotates downward to the open position.

It is clear that the three new shutter designs are ramped shutters also since a plug blade sliding down an angled surface opens the shutters by rotational motion. It is also clear that the units 100, 101, and 102 are vulnerable to defeat by two foreign objects like the current tamper resistant receptacles required by the Federal Electrical Code, but these internal shutters are not subject to rejection as the current models are.

A lock control assemblies and shutters is designed to be incorporated into safety electrical receptacles to prevent access to power by objects other than standard plugs. The assembly includes a top cap, a lock control assembly, one or two lock control mechanisms, and a shutter. The top cap has one or two socket faces with standard power blade slots and ground openings. The lock control assembly is provided under one or both power blade slots of each socket face. The lock control assemblies comprise a frame with a blade slot sized to pass the neutral blade of a polarized plug directly under the top cap and in line with the top cap blade slot it underlies. The frame has a shape to meet the requirements of the lock control mechanisms which mount on it. One or two lock control mechanisms are mounted on the frame. Each lock control mechanism has an intruding portion which extends under the frame slot and a lock bar portion having a locked position and an unlocked position. The shutter on or under the lock control assembly has open and closed positions. A spring is biased in the closed position which blocks a plug blade from passing through the lock control assembly-shutter combination but allows such passage in the open position. The shutter has two to four impeding surfaces which interact with lock bars in the locked position to prevent shutter opening, but free to open when all lock bars are in their unlocked position. The shutter has one or two ramps in the plug blade pathways which move the shutter from the closed position to the open position when a plug is inserted.

An electrical receptacle with a case having support structure to mount one or two lock control assemblies with their associated shutters directly under each socket face, a mounting strap which surrounds the case, has a ground terminal on the mounting strap, and is bound to the case by rivets through the case and ground tine receivers, the receptacle having the usual power buses, blade receivers, and power connectors.

A lock control module designed to be installed in a receptacle case having a mounting strap which surrounds the case, a ground terminal on the mounting strap, and is bound to the case by rivets through the case and ground tine receivers, the receptacle case having the usual power buses, blade receivers, and power connectors and containing the support structure for two lock modules; the lock modules comprised of a base plate having the support structure for two lock control assemblies, walls for shutter guidance and an orienting pin preventing the module from being installed incorrectly in a receptacle case; a shutter having an open and a closed position, spring biased in the closed position and one or two ramps which cause the shutter to move to the open position when a standard plug interacts with the ramps; and a top cap with a socket face with openings for standard plugs, two partial rims preventing the module from passing through a receptacle cover, and two walls holding the shutter in place on the base plate floor.

The receptacle containing the lock control modules of the prior paragraph can also be provided.

The receptacle of the prior paragraph can be provided in which the lock control modules are removable and replaceable from the receptacle case, the mounting structure securing the lock control modules in the receptacle case comprising four "L" shaped spring clips attached to the module base plate on opposing flat sides, four ramped stops on the two corresponding module supporting walls, and openings through the mounting strap and receptacle case to allow pins to unhook the two spring clips nearest the mounting strap from their stops.

The shutter and shutter lock control assemblies of the prior paragraphs can be provided in which the lock control assemblies consist of a metal frame with a wide blade slot, one or two lock control mechanisms, each consisting of a spring having first and second ends, the first end attached at an end of the mounting frame, shaped to intrude under the narrow end of the frame slot far enough to interact with any entering plug blade, and the second end as a locking bar lying in contact with an impeding surface of the shutter preventing its movement, the mechanism configured so that the insertion of plug blades into the lock control assembly moves the locking bars away from the impeding surfaces.

The shutter and shutter lock control assemblies of the prior paragraphs can be provided in which the lock control assemblies consist of one or two lock control mechanisms on a mounting frame with a wide blade slot, each frame having a pair of downwardly bent extensions at each end holding a shaft bearing a torsion spring upwardly biased, rotating intruder which extends under the frame slot's narrow end to interact with an entering plug blade, the non-intruding ends of the intruders being rounded with a central flat spot in contact with a locking bar which is attached to the frame on the one end, the other end lying against an impeding surface on the shutter to prevent shutter movement, and the combined parts configured so that rotation of each intruder moves a locking bar out of contact with an impeding shutter surface and freeing the shutter to move to the open position when all the lock bars are removed from contact with shutter impeding surfaces.

The shutter and shutter lock control assemblies of the prior paragraphs can be provided in which the lock control assemblies consist of one or two lock control mechanisms on a mounting frame with a wide blade slot, rectangular cavities under the frame top on each end to house plungers spring biased against a stop in the cavity but able to slide back and forth within the cavities, the plungers having a ramped front portion which intrudes into the area beneath the frame slot so that a plug blade entering the slot interacts with the plunger ramp causing the plungers to retreat into the cavity, each plunger having a locking bar attached to it, configured so that the plunger's retreat into the cavity moves the attached locking bar from a locked position against an impeding surface on the shutter to an unlocked position away from the impeding surface allowing the shutter to move to the unlocked position when all the lock bars have been moved to their unlocked position and the plug blade interacts with the shutter ramp.

The shutter and shutter lock control assemblies of the prior paragraphs can be provided in which the lock control assemblies consist of two lock control mechanisms on a mounting frame with a slot sized for the wide neutral blade of a plug, the frame having a centrally located downwardly bent extension, two locking bars sandwiched between the downward extension and a backer frame attached to the frame top, the locking bars having lateral extensions in opposite directions, both extensions being downwardly biased by torsion springs, the extensions having flat portions which lie atop the rounded ends of two intruders having rounded ends and pointed ends, the intruders being free to rotate on a shaft mounted parallel to the frame slot and at each end of the frame, the pointed ends of the intruders extending under the slot from the long slot side, configured so that the entrance of a plug blade into the lock control assembly rotates both intruders, thereby lifting both locking bars away from impeding surfaces on the shutter, the impeding surfaces being the back side of the shutter ramps.

The shutters and lock control assemblies of the first paragraph in which two lock control mechanisms move lock bars laterally from locked positions relative to shutters mounted on the lock control assembly frame to an unlocked positions allowing a shutter to open, the lock bars of the two lock control mechanisms having a shoes shaped to prevent shutter opening in the locked position.

The lock control assemblies of the prior paragraph can be provided in which the shutter consists of two spring leaves of spring material as wide as the frame slot and attached to the long sides of the frame slot, the leaves extending downwardly parallel to each other, then angling toward each other, then extending downward with the lower extremities overlapping, the lock bar shoes of the two lock control mechanisms having slots slightly wider than the overlapping section of the shutter leaves which confine the shutter leaves to the closed position when the lock bars are in the locked position, but free to open when a plug blade moves the lock bar shoes away from the shutter.

The lock control assemblies of the prior shutter paragraph can be provided in which a leaf shutter mounted in and as wide as the frame slot consists of a roughly "L" shaped spring leaf in which the angle between the two legs is greater than 90 degrees, and lying against a stop attached to and extending downward from the frame, the stop having a lip curving slightly beneath the shutter's lower end, the shoes of the lock bars in the locked positions shaped to fit the angle of the shutter and lying under the short leg of the "L" shaped shutter, the shoe being guided and supported by supports allowing the shoes to slide out from underneath the shutter when a plug blade moves the lock bars laterally to the unlocked position allowing the shutter to open.

The lock control assembly of the prior shutter paragraph can be provided in which the two lock control mechanisms consist of a frame having downwardly extending sections having openings as a bearing surface, a rotating shutter having two round extensions on either side of a rectangular section which covers the frame slot, the round extensions with a torsion spring installed on each side of the rectangular shutter section to bias the shutter upwardly, the round shutter extensions lying in the downwardly extending frame section openings with spacers if needed to keep the shutter from sliding laterally, the lock bar shoes of the lock control mechanism in the locked position extending slightly under the shutter side opposite the round extensions, the lock bar shoes being guided and supported by supports allowing the shoes to slide out from underneath the shutter when a plug blade moves the lock bars laterally to the unlocked position allowing the shutter to open by rotating downward as the blade passes through the lock control mechanism.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

I claim:

1. A safety electrical receptacle, comprising:

a housing; and a lock module carried by the housing having:

a top cap having at least one socket face having a pair of standard plug blade slots and a ground opening;

a plug blade geometric dimension detector provided proximate at least one of the plug blade slots of the socket face comprising a frame with a blade slot sized to pass one of the plug blades of a polarized plug directly under the top cap and in line with and beneath the top cap blade slot and configured to detect a geometric dimension of the plug blade;

at least one lock control mechanism carried by the housing and having an intruding portion extending under the frame blade slot and a lock bar portion movable between a locked position and an unlocked position relative to the housing; and a shutter provided proximate the plug blade dimension parameter detector having open and closed positions having a spring configured to bias the shutter in the closed position to block a plug blade from passing through the lock control mechanism and the shutter, and allowing passage when in the open position, the shutter having at least one impeding surface configured to interact with the lock bar when in the locked position to prevent opening of the shutter and free to open when the lock bar is in the unlocked position;

the lock bar configured to prevent movement of the shutter when in the closed position, the at least one impeding surface configured to interact with the shutter to prevent movement of the shutter when in the closed position and allow movement of the shutter when in the open position.

2. The safety electrical receptacle of claim 1, wherein the shutter is configured to move in a linear motion between the open position and the closed position.

3. The safety electrical receptacle of claim 1, wherein the shutter is configured to rotate between the closed position and the open position, the shutter comprises a ramp configured to interact with an inserted plug blade to laterally slide the shutter to an open position.

4. The safety electrical receptacle of claim 1, wherein the lock control mechanisms are encased in a self-contained module comprising a top cap with blade slots, a sliding shutter, and a base plate with the supporting structure and exit blade slots, the module configured to be mounted on a receptacle case.

5. The safety electrical receptacle of claim 1, wherein the lock module is removable and replaceable.

6. The safety electrical receptacle of claim 1, wherein the lock control mechanisms and the shutters are positioned on a support structure within a receptacle case and under the blade slots of the top cap.

7. The safety electrical receptacle of claim 1, wherein the lock control mechanism comprises a resilient member attached to the frame configured to extend into the plug pathway an amount to move an unattached end of the lock bar away from an impeding surface on the shutter.

8. The apparatus of claim 1, wherein the lock control mechanism comprises an upwardly biased rotating intruder having a back side radius that increases with rotation and which lies against a lock bar attached to the frame, the intruder extending into the blade pathway an amount sized to bend the lock bar as the intruder rotates with encountering an incoming blade, the rotation of the intruder causing a back side of the intruder to bend a lock bar away from an impeding surface on the shutter.

9. The apparatus of claim 1, wherein the lock control mechanism comprises a ramped plunger encased by the frame and with a lock bar attached, the ramped portion extending into the blade pathway an amount sized to be retracted by the interaction of an incoming plug blade, moving the attached lock bar away from an impeding surface on the shutter.

10. The apparatus of claim 1, wherein the lock control mechanism comprises an upwardly biased rotating intruder having a back side with a lifter extension configured to lift a lock bar from an impeding surface on the shutter when a plug blade having a complementary width is inserted and rotates the intruder and the lifter extension.

11. A method of electrically protecting an electrical connection at a socket face, comprising:

providing a receptacle with a socket with a pair of power blade slots and a ground opening, a shutter to block a plurality of plug blade slots, a power blade geometric dimension detector provided with each of the plurality of plug blade slots, and a shutter movement lock having a lock bar provided in association with each of the plurality of plug blade slots for locking and unlocking movement of the shutter when the plurality of lock bars are unlocked;

inserting the plug blades from a standard plug into the socket;

while inserting, detecting a geometric dimension of each of the plurality of plug blades;

in response to detecting the geometric dimension, unlocking each of the shutter lock bars;

in response to unlocking the shutter lock bars, unlocking the shutter to unblock the plug blade slots and receive a respective one of a plurality of the plug blades.

12. The method of claim 11, further providing a lock control mechanism with a portion extending into the blade pathway an amount sized to interact with an incoming blade and a lock bar moving mechanism that moves the lock bar, wherein the step of detecting a geometric dimension comprises extending the portion into the blade pathway to interact with the incoming blade and activate the lock bar moving mechanism that moves the lock bar from a locked position into an unlocked position.

13. The method of claim 11, further providing a ramp under one or more of the blade slots, wherein the step of unlocking the shutter comprises engaging one or more of the blade slots with an incoming one or more plug blades to move the shutter to an open position where both blade slots are open, enabling the plug blades to pass through to a power source.

14. The method of claim 13, wherein the shutter is slide laterally responsive to one or more of the plug blades engaging with the shutter.

15. A safety electrical receptacle, comprising:

a housing; and a lock module carried by the housing having:

a top cap having at least one socket face having a pair of standard plug blade slots and a ground opening;

a plug blade geometric dimension detector provided proximate at least one of the plug blade slots of the socket face comprising a frame with a blade slot directly under the top cap and in line with and beneath the top cap blade slot and configured to detect a geometric dimension of the plug blade;

at least one lock control mechanism carried by the housing and having an intruding portion extending under the frame blade slot and a lock bar movable between a locked position and an unlocked position relative to the housing; and a shutter provided proximate the plug blade geometric dimension detector having open and closed positions having a spring configured to bias the shutter in the closed position to block a plug blade from passing through the lock control mechanism and the shutter, and allowing passage when in the open position, the shutter configured to interact with at least one lock bar against a stop when in the locked position to prevent opening of the shutter when in the closed position, the at least one lock bar against a stop configured to interact with the shutter to prevent movement of the shutter when in the closed position and allow movement of the shutter when in the open position.

16. The safety electrical receptacle of claim 15, wherein each lock control mechanism moves a single lock bar away from a lock bar stop when a geometric dimension of an incoming plug blade is correct, allowing the shutter to move to the open position when each lock control mechanism has been unlocked, allowing the blade to access power.

17. The safety electrical receptacle of claim 15, wherein a shutter underlies each power blade slot comprised of two leaves attached on each side of the slotted frame, the leaves having a straight portion, the two leaves angled to come together, with one leaf overlapping the end of the other leaf.

18. The safety electrical receptacle of claim 17, wherein two lock control mechanisms per power blade slot have lock bars with notched shoes, notches on the notched shoes encompassing the overlapping ends of the shutter leaves, preventing opening of the shutter leaves in the closed position, but allowing the shutter leaves to open when the lock control mechanism moves the shoes away from the shutter leaves.

19. The safety electrical receptacle of claim 15, wherein the shutter comprises a single resilient sheet attached to the frame, shaped like an "L" with an oblique angle between the legs, an unattached end of the angle biased against a stop attached to the frame.

20. The safety electrical receptacle of claim 15, wherein the shutter comprises a rotating shutter mounted on the frame, spring biased in the closed position to block the blade slot.

21. The safety electrical receptacle of claim 15, wherein the lock control mechanism provides shoes that underlie the shutter in the closed position preventing rotation of the shutter, but moved out from under the shutter when the lock control mechanism finds an incoming plug blade of a correct geometric size, allowing the plug blade to pass through to a power source.

* * * * *